US006780083B2

(12) United States Patent
Ising et al.

(10) Patent No.: US 6,780,083 B2
(45) Date of Patent: Aug. 24, 2004

(54) APPARATUS AND METHOD FOR THE CHEMICAL MECHANICAL POLISHING OF THE SURFACE OF CIRCULAR FLAT WORKPIECES, IN PARTICULAR SEMI-CONDUCTOR WAFERS

(75) Inventors: Ulrich Ising, Büdelsdorf (DE); Marc Reichmann, Eckernförde (DE); Thomas Keller, Eckernförde (DE)

(73) Assignee: Peter Wolters CMP-Systeme GmbH & Co. Kg, Rendsburg (DE)

( * ) Notice: Subject to any disclaimer, the term of this patent is extended or adjusted under 35 U.S.C. 154(b) by 65 days.

(21) Appl. No.: 10/125,862

(22) Filed: Apr. 19, 2002

(65) Prior Publication Data

US 2003/0199225 A1 Oct. 23, 2003

(51) Int. Cl.[7] ..... B24B 51/00

(52) U.S. Cl. ..... 451/5; 451/287; 451/41; 451/285

(58) Field of Search ..... 451/5, 57, 66, 451/285–289, 41

(56) References Cited

U.S. PATENT DOCUMENTS 5,649,854 A * 7/1997 Gill, Jr. ..... 451/290
6,050,885 A 4/2000 Morsch et al.
6,062,954 A * 5/2000 Izumi ..... 451/72
6,354,922 B1 * 3/2002 Sakurai et al. ..... 451/67
6,447,385 B1 * 9/2002 Togawa et al. ..... 451/397

FOREIGN PATENT DOCUMENTS

DE 197 19 503 a1 11/1998

* cited by examiner

*Primary Examiner*—Hadi Shakeri
(74) *Attorney, Agent, or Firm*—Vidas Arrett & Steinkraus, P.A.

(57) ABSTRACT

An apparatus for the chemical-mechanical polishing of surfaces of circular flat workpieces, in particular semiconductor wafers, comprising a loading and unloading station for the workpieces which includes a carrier which is supported for rotation about a vertical axis and is driven by a rotary driving means into a predetermined rotary position, at least two horizontal loading surfaces on the carrier means facing upwardly. With a transfer means the workpieces can be placed on the loading surfaces or removed therefrom. At least two polishing tables in corresponding polishing stations are provided which are located at the circumference of the carrier means and at least two chucks for the workpieces, the chucks being adapted to be moved along a vertical and a horizontal axis by moving means to align the chuck with a loading surface, to hold and discharge a workpiece and for the transfer of the workpiece as well to the associated polishing station and away therefrom and for the cooperation with the polishing table of the associated polishing station and a control means for the rotary driving means, the actuation means and the moving means.

26 Claims, 19 Drawing Sheets

APPARATUS AND METHOD FOR THE CHEMICAL MECHANICAL POLISHING OF THE SURFACE OF CIRCULAR FLAT WORKPIECES, IN PARTICULAR SEMI-CONDUCTOR WAFERS

CROSS REFERENCE TO RELATED APPLICATIONS

Not Applicable.

STATEMENT REGARDING FEDERALLY SPONSORED RESEARCH

Not Applicable.

BACKGROUND OF THE INVENTION

After each coating of a semi-conductor wafer, e.g. with an oxide layer, a tungsten layer or other metal layers, a processing has to take place in order to achieve planar surfaces. Otherwise, problems may occur with lithographic processes in form of focus failures of the UV stepper or in form of damages of the conductor paths. A common method in the semi-conductor industry for the planarization uses the so-called CMP process. This is a chemical-mechanical treatment by means of the fluid (slurry), whereby the chemically reactive part of the slurry has the objective to convert the material into a polishable condition. The slurry includes an abrasive in the form of colloidal abrasive small particles.

From the DE 197 19 503 A1 an apparatus for the chemical-mechanical polishing of surfaces has become known. It includes two polishing stations with vertically movable vacuum chucks for a semi-conductor wafer. The polishing stations have polishing tables which can be rotated about a vertical axis. The vacuum chucks are guided along two parallel horizontally extending guides. By this, two wafers can be polished by a polishing table contemporarily. At least one transfer means for the wafers is provided. Furthermore, on opposing sides of the guides loading and unloading means for the wafers are provided which can be aligned with the vacuum chucks. The transfer means normally are formed by a robot.

During the transportation and the processing the wafers are held by a vacuum chuck or a carrier. This has the task to transfer a homogenous pressure field or different pressure profiles onto the back side of the workpiece. The so-called sharp surface, i.e. the surface which is provided with circuits is facing the polishing table. Usually, the chuck is retained and moved by a corresponding actuating means which rotates the carrier about a vertical axis and moves it along linearly in vertical and horizontal direction.

The throughput through a CMP apparatus is mainly dependent upon the number of polishing stations. On the other side, the processing times for the planarization are relatively short (typically 90 seconds). Due to the short processing times bottlenecks may occur between the individual sections and limit the throughput.

It is an object of the invention to provide an apparatus for the chemical-mechanical polishing of workpieces, in particular of semi-conductor wafers, whereby the complete time of the workpieces within the apparatus can be reduced.

BRIEF SUMMARY OF THE INVENTION

In the invention the loading and unloading station includes a carrier which is supported for rotation about a vertical axis and which is rotated by a rotary driving means.

The rotatable carrier has at least two horizontal loading surfaces exposed upwardly. In the apparatus according to the invention further at least two polishing stations are associated with a circumference of the rotatable carrier. Two polishing stations preferably are located on diametrically opposed sides of the carrier. A third polishing station can be provided which has an offset with respect to the first polishing stations about an angle of 90°. Two transfer means are diametrically opposed to the last-mentioned polishing station. The transfer means is to load and unload the workpieces to and from the loading surfaces.

The CMP processes can be carried out by two or more steps, whereby the workpieces are planarized in different polishing stations. By using different chemical substances and polishing cloths in the different polishing stations, different materials, as for example tungsten, copper or titanium nitrite can be worked under optimized conditions. It is important to minimize the transportation times of the workpieces between the polishing stations as the chemical components of the first step may quickly etch the workpiece. In the apparatus according to the invention, a fast transportation from one polishing station to another can take place. By a quick exchange of the workpieces between the polishing stations, the throughput can be increased and the secondary times can be reduced. By the described configuration of the loading and unloading station according to the invention two or more polishing stations can be interconnected so that a fast exchange between the stations can be achieved. Also with a one step process the throughput time can be reduced since the workpieces can be treated during their transport on the loading surface, e.g. a chemical pretreatment can take place and/or a rinsing or cleaning after the polishing step.

In the present CMP process technology it is usual to clean the workpiece after the first polishing step in order to minimize the described disadvantageous effects or to eliminate these effects. In the already discussed publication DE 197 19 503 or U.S. Pat. No. 6,050,885 it has become known to provide a stationary cleaning means. According to the invention, a cleaning means can be associated with the carrier so that during the transport of the workpiece on the carrier a cleaning can take place. As a consequence, undesired etchings on the workpiece can be effectively prevented by cleaning the workpieces during transportation. Additionally, the so-called cross contamination between the polishing stations in a two step process can be eliminated.

The positioning of the workpieces on the loading surfaces by means of the transfer means normally is such that the workpieces are centered prior to being picked up by a chuck. Therefore, the loading surfaces of the apparatus according to the invention are associated with center means which cooperate with the circumference of the workpiece on the loading surface in order to align the workpiece to a predetermined vertical axis. The vertical axis of the chuck can be also aligned with this axis so that a lowering of the carrier onto the workpiece on the loading surface the chuck can pick up the workpiece in a centered manner.

The chuck for the transport of the workpieces and the cooperation with the polishing tables in the polishing station can be formed in a usual way. Preferably, the workpieces are held by vacuum. For the removing of the workpieces from the chuck an air pressure pulse can be generated after switching off of the vacuum. The movement of the chucks along vertical and horizontal axes has already become known and can be carried out as disclosed by U.S. Pat. No. 6,050,885.

From the mentioned publication, it is also known to provide a linear guide for the chucks, with two chucks being provided for each polishing table. The chucks can be moved along the guide independent from each other. For this case, it is of advantage if the carrier has four loading surfaces, with each two loading surfaces having an axis which is in a plane parallel to the guides if the carrier has a corresponding rotary position. By this, per chuck one loading surface can be provided whereby the throughput of the workpieces upon polishing can be considerably increased, in particular in connection with a two or multiple step planarization process. The positioning of the four loading surfaces preferably takes place in steps of 90° or multitude of 90°.

A cleaning means is associated with the carrier. For this, the carrier can include a central elevation which per loading surface positions a nozzle which is connected to a fluid source. By the nozzle cleaning liquid can be sprayed onto the processed surface of the workpiece. The nozzle can also serve to wet the surface of the workpiece by a suitable liquid. In such an elevation also a number of detectors can be mounted which detect whether a workpiece is on a loading surface.

It is necessary to center the workpieces on the loading surfaces so that they can be picked up by a chuck in a centralized manner. As to this, different known structures can be used. According to an embodiment of the invention, a plurality of centering cams are provided which are located on a circle and which have support surfaces which accommodate a marginal portion of the workpiece. The centering cams further include radially adjustable stop surfaces which may engage the circumference of the workpiece in order to align the workpiece with respect to a predetermined vertical axis. To this purpose, the stop surfaces are synchronously actuated.

The loading surfaces can have a concave shape so that the space between an accommodated workpiece and the loading surfaces can serve as cleaning chamber. It is further possible to drain liquid from this cleaning chamber to one or more bores in the loading surface. Furthermore, a nozzle can be arranged in the loading surface for the supply of cleaning fluid to the described chamber between workpiece and loading surface. Finally, by means of such measures the contact surface of the chuck can be cleaned if it is lowered onto the loading surface.

With the invention a multi function apparatus is created by which through a rotary movement the individual polishing stations and the transfer means could be interconnected in order to decrease the transportation times as short as possible. Furthermore, by means of the multi function apparatus the throughput can be increased, in particular in a two step or multiple step process, wherein different materials as for example tungsten, copper or titanium nitrite is to be processed with different chemical substances and polishing cloths in different polishing stations. By the integration of suitable rinsing and cleaning means, it is possible to avoid etching and chemical reactions which can occur by remainders on the workpieces. Furthermore, the multi function apparatus according to the invention prevents the so-called cross contamination, i.e. the transportation of different materials and chemical components between the polishing stations. Furthermore, the rinsing and cleaning means can be used for a chemical pretreatment of the workpieces in order to prepare the workpieces for the second and third polishing step. Since the cleaning, the pretreatment and the like takes place during the transportation, the throughput speed is not affected.

BRIEF DESCRIPTION OF THE SEVERAL VIEWS OF THE DRAWINGS

In the following, embodiment examples of the invention are described in more detail along accompanying drawings, wherein.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

Figure 1:
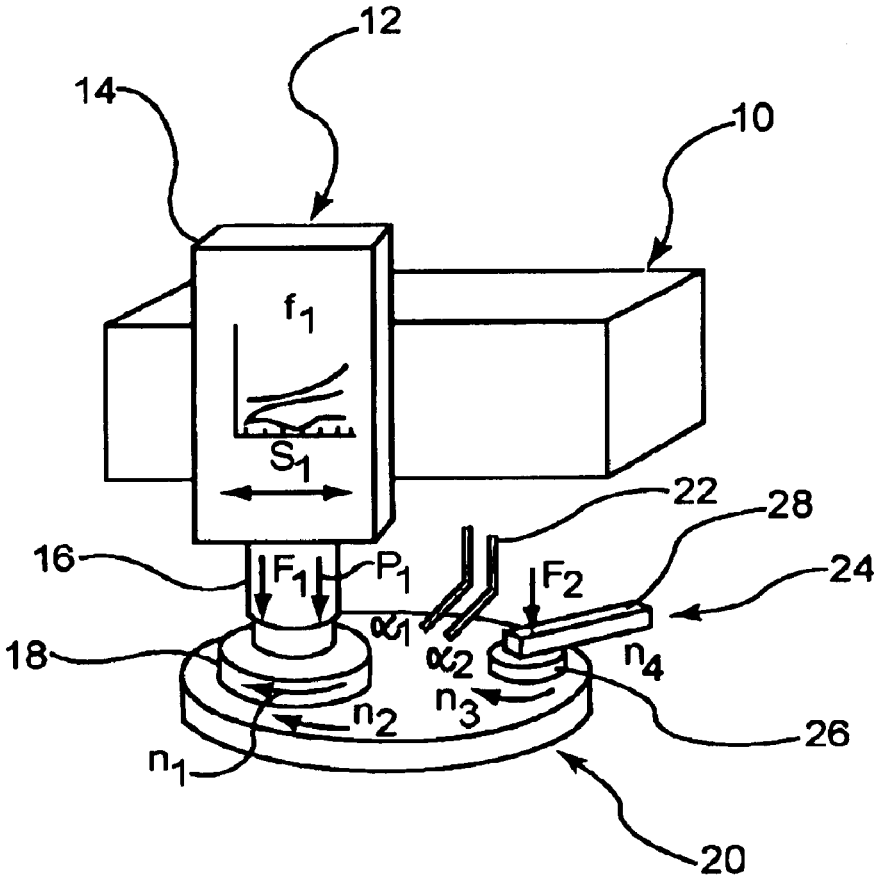
FIG. 1 shows diagrammatically the processing of a semiconductor wafer with a polishing table.

FIG. 1 shows diagrammatically the known structure of a polishing station, e.g. for a semi-conductor wafer. A polishing unit 12 is supported for linear movement along a horizontal linear guide 10 and is moved along the guide by a not shown driving means. This is indicated by double arrow $S_1$. The upper portion 14 which is guided by guide 10 supports a spindle 16 which can be rotatably driven by a not shown motor. The spindle is also vertically movable. A chuck 18 is mounted to the lower end of the spindle for the holding and transportation of a semi-conductor wafer not shown. The chuck can be rotatably driven by spindle 16, i.e. with speed n1. A rotatable driven polishing table 20 is arranged below the chuck 18 as is usually used for the planarization of wafers. The polishing disk or table is rotated with the revolution n2. On the polishing cloth of the polishing table 20 a slurry is supplied by a device 22, e.g. with the amounts of $\alpha 1$ and $\alpha 2$. By means of a not shown mechanism for the elevation of spindle 16 a pressure b1 can be exerted in order to press the wafer with a predetermined pressure against the polishing table 10.

A not shown dressing mechanism 24 includes a dressing disk 26 which is rotatably supported by an arm 28 and is driven by the revolution n3. The force by which the dressing disk is pressed is designated with $F_2$.

Figure 2:
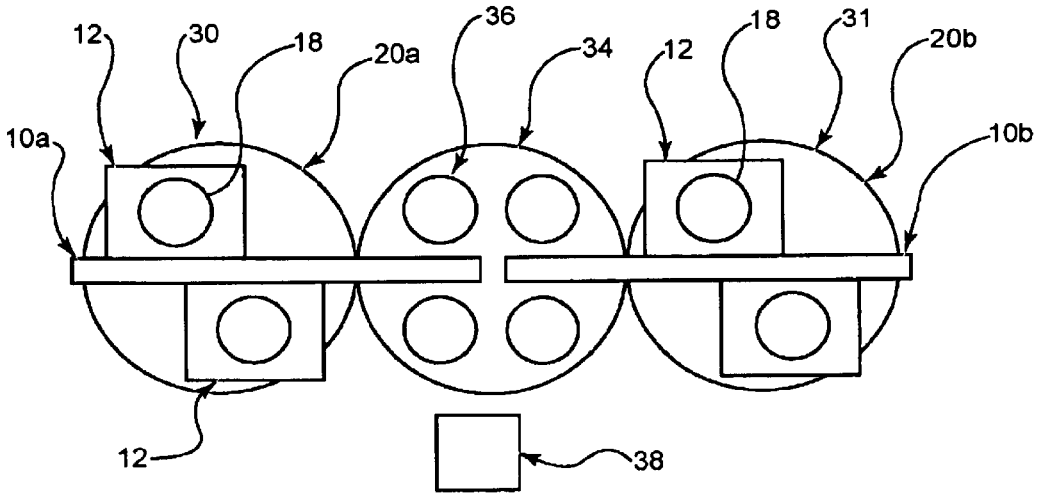
FIG. 2 shows the view on a diagrammatically depicted apparatus according to the invention.

In the illustration of FIG. 2, two polishing stations 30, 31 are provided which resemble that of FIG. 1, two polishing units 12 being associated with each polishing station which are guided by linear guides 10*a*, 10*b*. The linear guides 10*a*, 10*b* are lying on an axis. The structure of the polishing units of FIG. 2 corresponds to that of FIG. 1. The arrangement of the polishing units on the guides 10*a*, 10*b* corresponds to that described in U.S. Pat. No. 6,050,885.

A circular carrier 34 is located between the polishing stations 30, 31 and supported for rotation about a central vertical axis. The rotary driving means are not shown. The guides 10*a*, 10*b* are extended right and left and extend over the carrier 34 approximately to the center thereof. The centers of the polishing tables 20*a*, 20*b* and of the carrier 34 are on a common axis which is parallel to the guides 10*a*, 10*b*.

Two loading and unloading stations 36 are arranged on the carrier on opposite sides of the axis which will be subsequently described in more detail. Their centers are positioned on a circle concentric to the rotary axis of carrier 34. Each of the four loading and unloading stations 36 is in a position to accommodate a wafer in a centered manner. The loading and unloading of these stations 36 take place by a diagrammatically illustrated robot 38.

In the rotary position shown in FIG. 2, the polishing units 12 can be aligned with two unloading and loading stations 36 in order to accommodate a wafer or to have a wafer removed. It is understood that a third polishing station can be provided. It is then located at the circumference of carrier 34 on the opposite side of robot 38.

Figure 3:
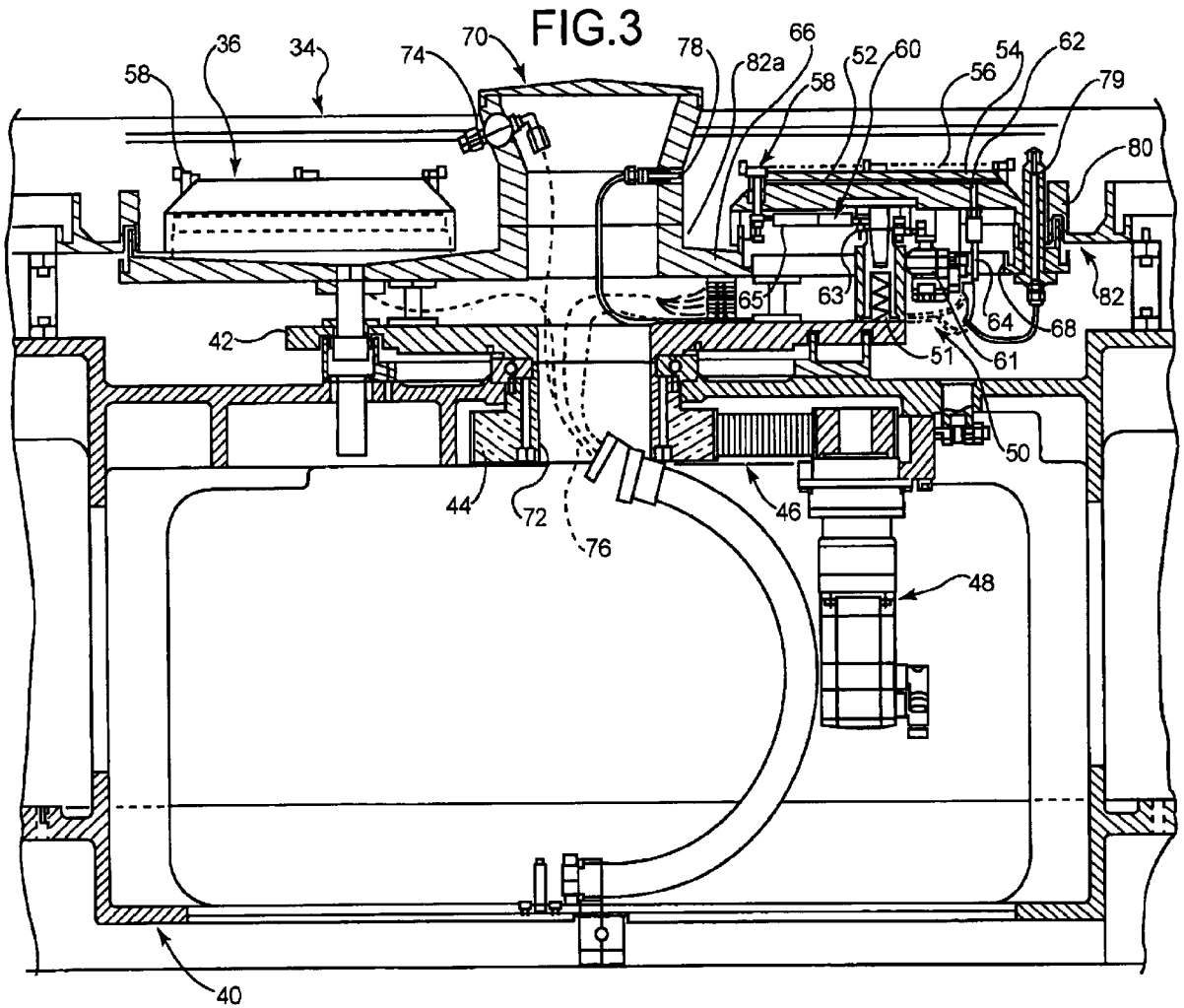
FIG. 3 shows a cross section through the carrier and the loading and unloading station of FIG. 2.
Figure 4:
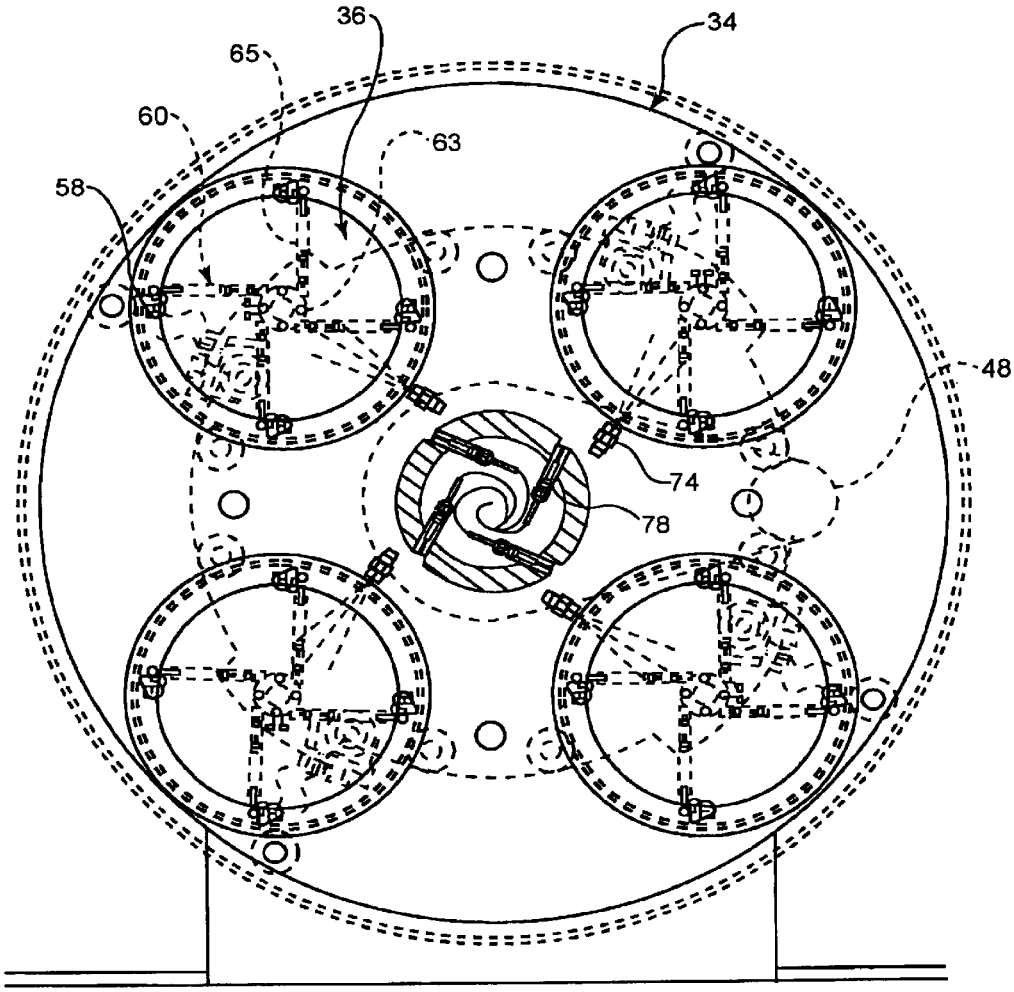
FIG. 4 shows the view onto the loading and unloading station of FIG. 2.

The structure of the loading and unloading stations is more clearly seen in FIGS. 3 and 4 which are to be described hereinafter.

A stationary frame 40 has an opening wherein the carrier 34 is supported for rotation about a vertical axis. It comprises a plurality of parts. A circular plate 42 is connected to a wheel 44 for rotation therewith, the wheel being driven about a vertical axis through a gear 46 and a driving motor 48. Plate 42 rotates with wheel 44. A trunnion-shaped holder 50 is mounted to plate 42. The holders 50 support cap-shaped elements 52. This support is axially resilient in axial direction by means of a spring 51. The upper side of the elements 52 form a loading surface 54 for wafers 56 which can be placed on the loading surfaces. Four centering cams 58 are positioned at the circumference on the loading surface 54 in a circumferentially spaced manner. The centering cams include a support surface not shown in detail for the wafers 56. Thereby, the wafers 58 are only supported on four spots at a marginal portion thereof (in FIG. 3 only two centering cams 58 can be seen). In FIG. 4 four centering cams 58 can be recognized. The radially movable centering cams have a stop surface which is radially moved by an actuation mechanism 60. This mechanism includes a motor 61 which effects on four rods 65 through a gear 63 in order to move the cams 58. These are formed as levers which are pivoted by the rods 65. The stop surfaces are also not shown. By means of the stop surfaces or the centering cams 58, respectively, a wafer disk accommodated can be centered with respect to a predetermined axis, e.g. the center axis of element 52.

The top wall of element 52 includes a throughbore 62 which is provided with a connection fitting 64 for a fluid. Through this fitting fluid can be conveyed to the lower side of the wafer accommodated. Furthermore, bores can be provided to remove liquid from the loading surface.

Spaced from plate 42 a plate 66 can be fixedly attached to plate 42 which in the area of element 52 has openings 68. In the center, plate 64 has an elevation 70 which has an inner hollow space, the elevation being aligned with an axial passage 72 from wheel 44 to plate 42. In the slightly oblique wall of elevation 70 a number of nozzles is arranged in the upper portion which is shown at 74. Each loading and unloading station 36 is associated with a nozzle 74 which is directed to a loading surface. A conduit connected to a fluid source is connected with nozzle 74 in order to spray a fluid onto the upper side of a wafer accommodated. Also a radiation source 78 is provided for each loading and unloading station 36 which is directed to the loading surfaces 54 and cooperates with a receiver 79 which indicates whether a wafer 56 is accommodated.

The carrier 34 is encircled by a sealing ring 80 of frame 40, a labyrinth sealing 82 being located between ring 80 and plate 66. A dripping tub (not shown) is below ring 80. Each cap-shaped element 52 is also provided with a dripping tub 82 in order to accommodate liquid or slurry, respectively, and to drain it to the tub for the complete system.

According to FIG. 2, the robot 38 can load wafers on two associated loading and unloading stations or remove wafers therefrom. It is also conceivable to bring the carrier into a rotary position wherein only one station 36 can be served by the robot 38. In the rotary position according to FIG. 2 the polishing unit then can only pick up one wafer from the loading and unloading means or place one wafer thereon. If the left polishing station is for the first processing while the next processing takes place in the right polishing station, the carrier 34 carries out a rotation about 180° after the placement of wafers on the associated loading and unloading stations so that the associated polishing unit can pick up the wafer and transport it to the associated half of polishing table 20*b*. During the rotation of carrier 34 the surface of the wafers can be cleaned, e.g. by means of nozzle 74 in order to remove remainders of a treating substance and to avoid an undesired etching. Thus, the loading and unloading station 36 in conjunction with carrier 34 is not only a means to center accommodated wafers to allow a centered pick up by chuck 18, rather, also a transportation means between two or more polishing stations and a cleaning station as well for the cleaning process to wafers prior to the further transport to the next polishing station or prior to the removal by robot 38.

The loading surfaces 54 can be shaped concavely so that a chamber is formed at the back side of the wafer 56 as already described. The loading surface can be provided with bores for the drainage of fluid or for the supply of fluid. In this way, also the back side of the accommodated wafers 56 can be cleaned. Furthermore, the contact surface of the chuck can be cleaned if it is lowered onto the loading surface.

It is understood that the described driving means for individual parts of the polishing system and the cooperation of these driving means can be controlled by a suitable not shown control device. Such control devices are generally known.

Figure 5A:
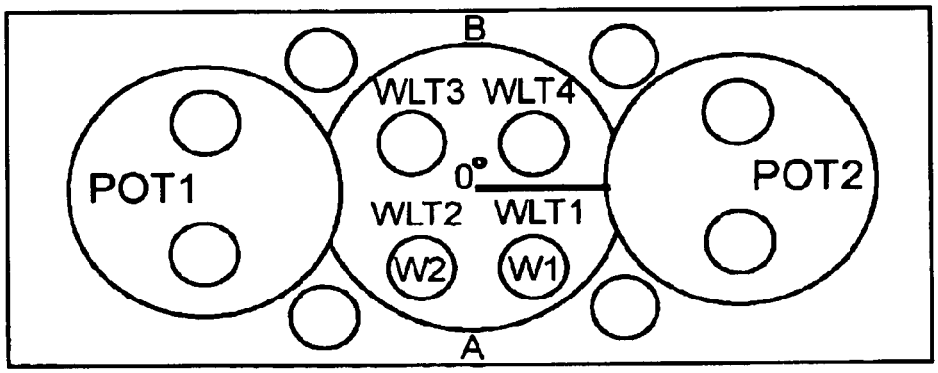
FIGS. 5*a* to 5*o* show diagrammatically the procedure of a two step polishing process according to the method of the invention.
Figure 5B:
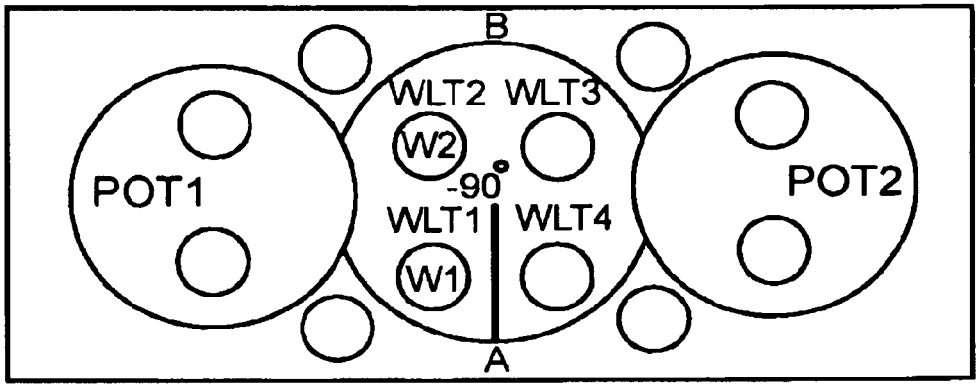
Figure 5C:
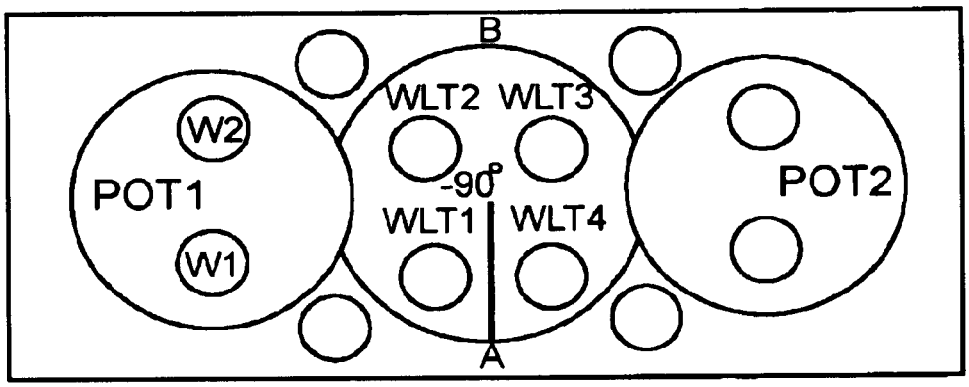
Figure 5D:
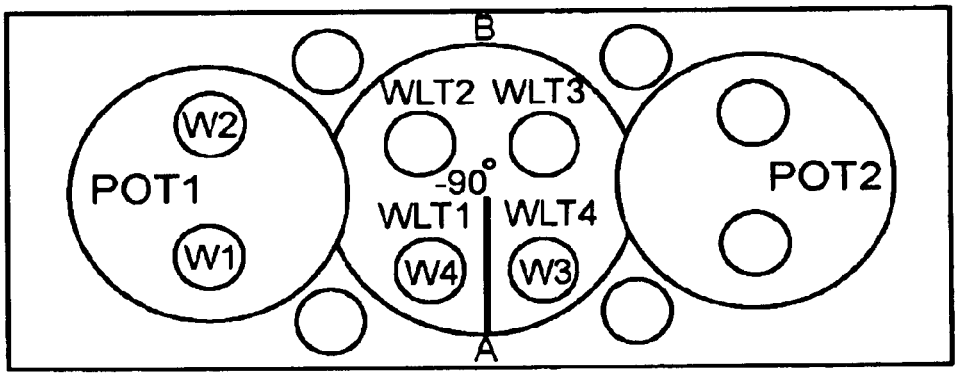
Figure 5E:
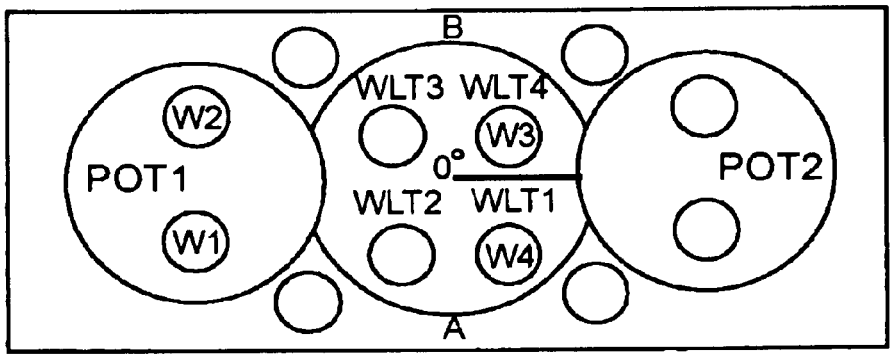
Figure 5F:
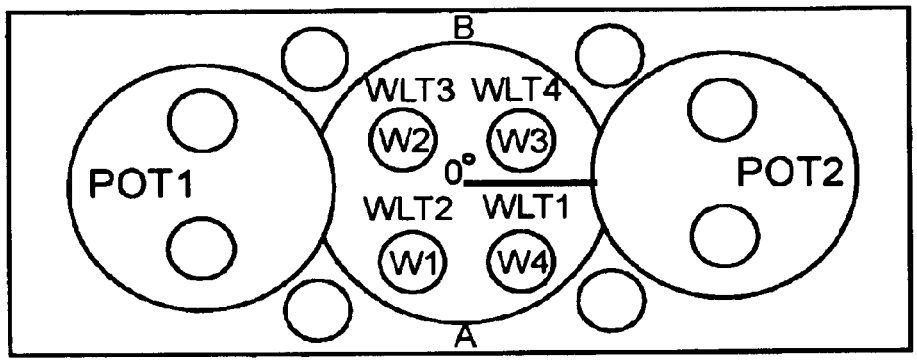
Figure 5G:
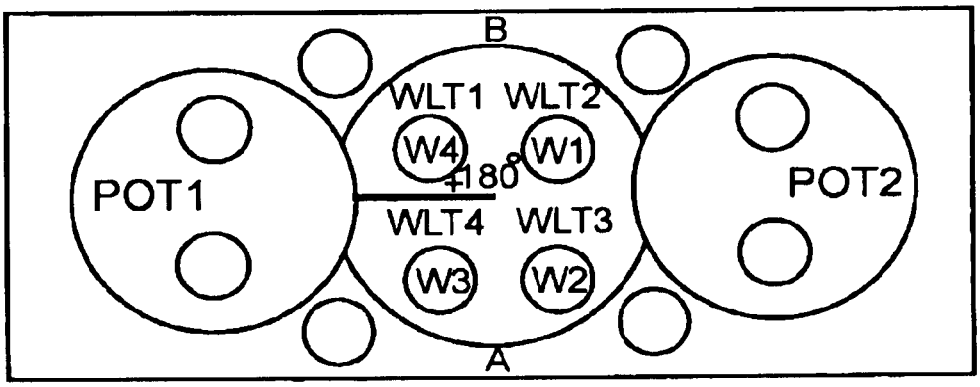
Figure 5H:
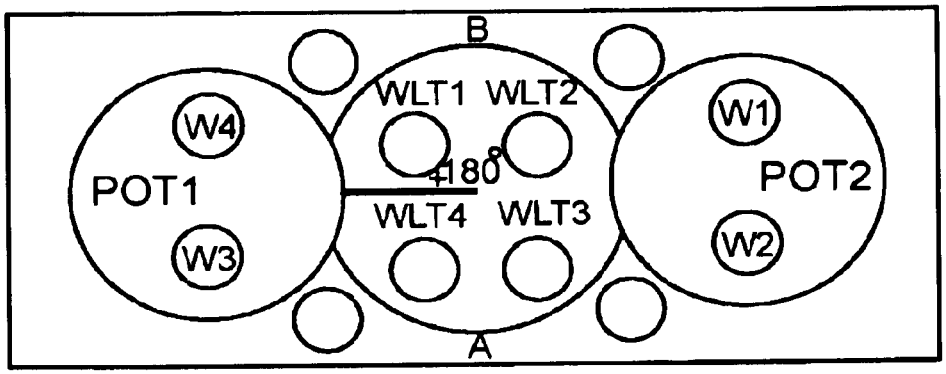
Figure 5I:
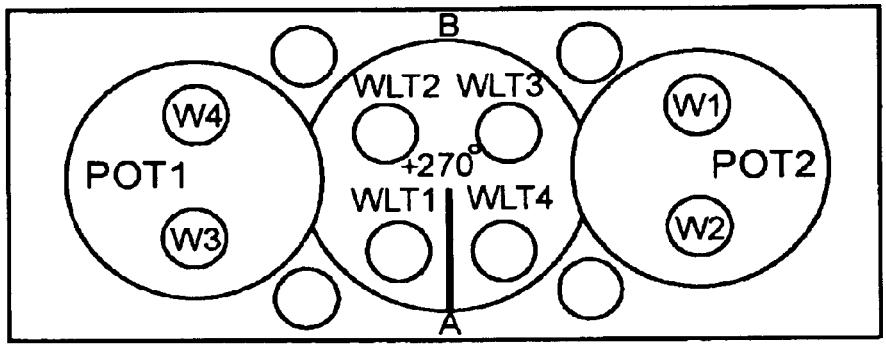
Figure 5J:
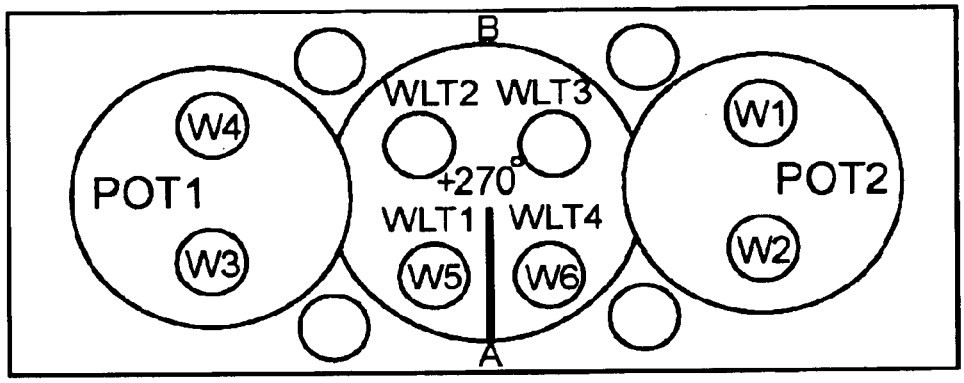
Figure 5K:
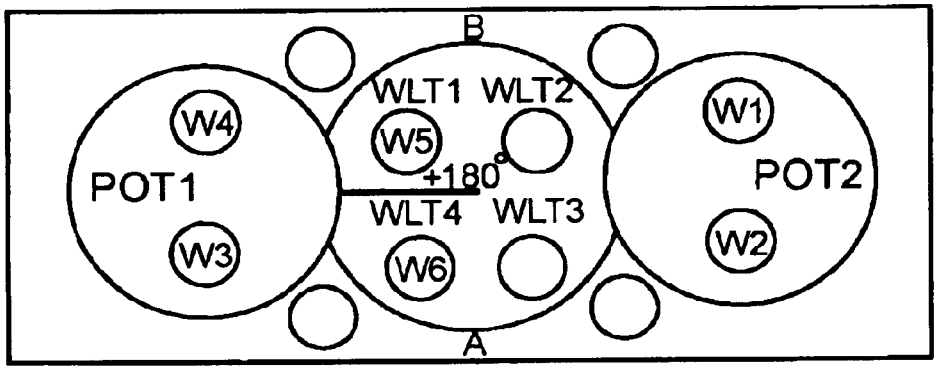
Figure 5I:
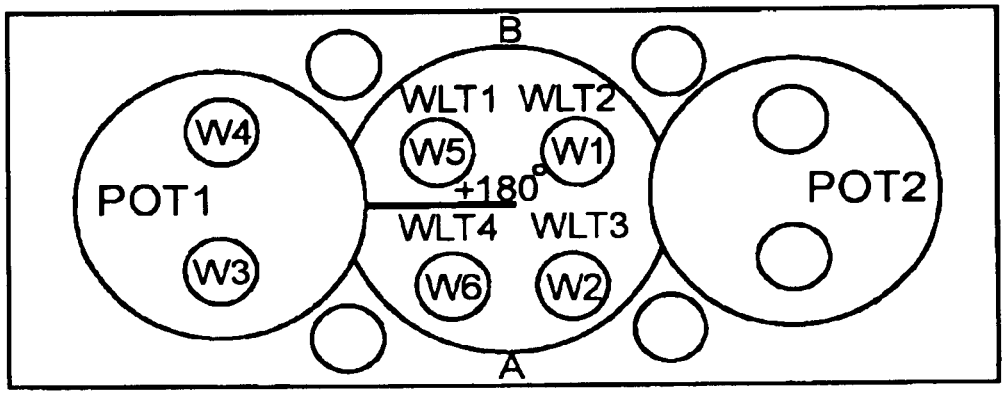
Figure 5M:
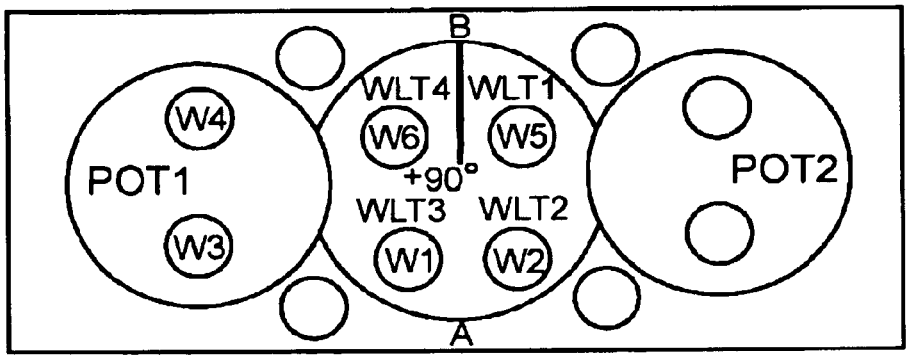
Figure 5N:
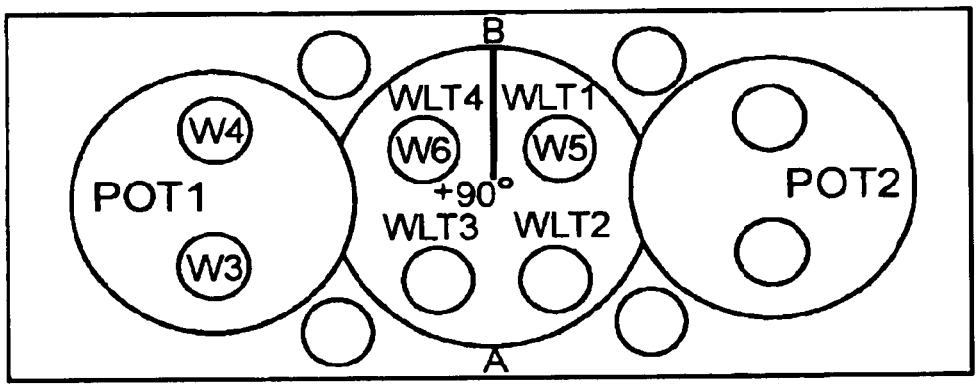
Figure 5O:
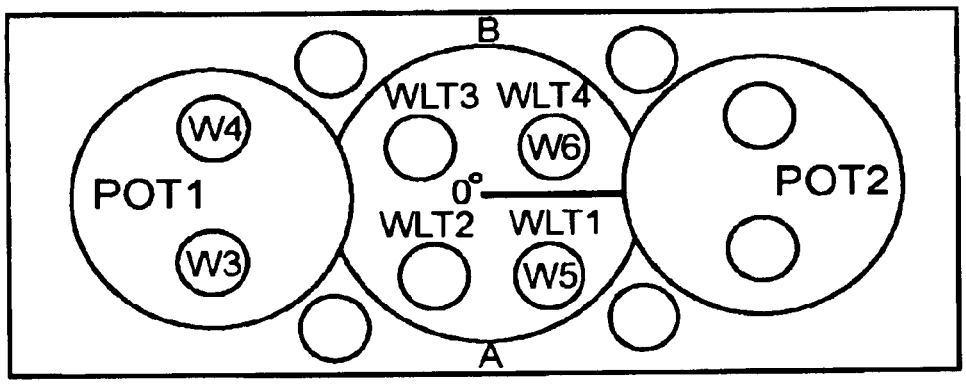

In the following, a two step polishing process is explained along FIGS. 5*a* to 5*o*. A rotating carrier is located between two polishing disks POT1 and POT2. The carrier has four loading surfaces WLT1 to WLT4. An arrangement can be used as shown in FIGS. 2 to 4. The transfer means 38 is not shown and also not the chuck (polishing units 18) by which the wafers can be transported and held against the polishing disk POT1 and POT2. In case of FIG. 5, the transfer means or robot is on side A of the shown arrangement. The opposing side is designated with B. For the sake of comprehensiveness in FIGS. 5*a* to 5*o* a radial line is shown. In FIG. 5*a* this line indicates the zero position of the carrier. In the other Figures, the position is indicated with 90° or a multitude of 90°.

In FIG. 5*a*, the loading surfaces WLT1 and WLT2 are loaded with workpieces W1 and W2. This takes place with the not shown transfer means and the loading can take place contemporarily or step-by-step. Subsequently, the carrier according to FIG. 5*b* is rotated about −90°, whereby the workpieces W1 and W2 are facing the first polishing disk POT1. In this position, the wafers can be picked up by the chucks and moved above the polishing disk POT1. This can be seen in FIG. 5*c*. Now, in this first polishing station the processing of the wafers W1 and W2 can take place.

As soon as wafers W1 and W2 are removed from the carrier, two further wafers W3 and W4 are placed on the loading surfaces WLT1 and WLT4. Afterwards, the carrier is rotated back about 90° into the zero position as can be seen in FIG. 5*e*. In this position, the wafers W1 and W2 can be brought back to the loading surfaces WLT2 and WLT3 after finishing of the polishing process. This is shown in FIG. 5*f*. Thereafter, the carrier is rotated about 180° as can be seen in FIG. 5*g*. In this position, the chucks which are associated with the polishing disk POT2 can transport the wafers W1 and W2 to the second polishing disk POT2 as shown in FIG. 5*h*. Contemporarily, the wafers W3 and W4 can be moved to polishing disk POT1 by the associated chucks.

During processing of the wafers W1 to W4 by the polishing disk POT1 and POT2, the loading surfaces WLT1 to WLT4 are empty. So, they can be loaded with further wafers W5 and W6 as shown in FIG. 5*j*. According to FIG. 5*k*, the carrier is rotated in clockwise direction so that wafers W5 and W6 are aligned to polishing disk POT1 while the empty loading surfaces WLT2 and WLT3 as associated with polishing disk POT2. In this position, the finished wafers W1 and W2 can be placed on the associated loading surfaces as shown in FIG. 5*l*. Thereafter, the carrier is rotated about further 90° so that the wafers W1 and W2 can be removed (as shown in FIGS. 5*m* and *n*). Thereafter the carrier is again rotated about 90° so that the wafers W5 and W6 are aligned with polishing disk POT2. Thus, the wafers W3 and W4 processed in the first station can be placed on the carrier. Thereafter, the further processing takes place as described in connection with FIG. 5*f* and the following.

During the presence of the wafers W1 to W6 on the loading surfaces they can be pretreated, rinsed and cleaned as already described above. By these process steps the complete throughput time in a two step polishing process for the wafers is not extended.

What we claim is:

1. An apparatus for the chemical-mechanical polishing of surfaces of circular flat workpieces, in particular semi-conductor wafers, comprising a loading and unloading station for the workplaces which includes:

a carrier (34) which is supported for rotation about a vertical axis and is driven by a rotary driving means (48) into a predetermined rotary position, at least two horizontal loading surfaces (54) on the carrier (34) facing upwardly, a transfer means (38) adapted to place workpieces on the loading surfaces (54) and to remove the workpieces therefrom, at least two polishing tables (20*a*, 20*b*) in corresponding polishing stations (30, 31) which are located adjacent to the carrier (34), a first linear guide (10*a*) between a first polishing station (30) and the carrier (34), a second linear guide (10*b*) between a second polishing station (31) and the carrier (34), each linear guide arranged to guide two chucks (18), each chuck moved by moving means and arranged to move along a horizontal axis and a vertical axis in order to align each chuck with one of the loading surfaces when the carrier (34) is in a predetermined position, each chuck arranged to transfer a workpiece between one of said loading surfaces and an associated polishing station, and control means for the rotary driving means (48) and the moving means.

2. The apparatus of claim 1, wherein the carrier (34) includes centering means (58, 60) for each loading surface (54), the centering means for each loading surface including centering elements which are actuated by actuation means and engage the circumference of a workpiece (56) on the loading surface (54) in order to radially position the workpiece (56) in alignment with a predetermined vertical axis.

3. The apparatus of claim 2, wherein for each loading surface the centering means has centering cams (58) arranged on a circle and being movable in a radial direction, the centering cams (58) including support surfaces for a marginal portion of a workpiece (56) and stop surfaces which upon a radial displacement of the centering cams engage a circumference of a workpiece (56), with the stop surfaces being moved synchronously by actuating means (60) in order to align the axis of the workpiece (56) with a predetermined vertical axis.

4. The apparatus of claim 1, wherein cleaning means are associated with the carrier means for the cleaning and hydrosation and/or the wetting of the surface of the workpiece (56) on the loading surfaces (54).

5. The apparatus of claim 1, wherein four loading surfaces (54) are provided on the carrier (34).

6. The apparatus of claim 1, wherein four loading surfaces (54) are provided on the carrier and the loading surfaces (54) are located such that in a predetermined rotary position of the carrier, a central vertical axis of a first loading surface (54), a central vertical axis of a second loading surface (54), a central vertical axis of a chuck of said first linear guide and a central vertical axis of a chuck of said second linear guide lie in a common vertical plane, the common vertical plane being parallel to a longitudinal axis of the first linear guide.

7. The apparatus of claim 1, wherein the carrier has a central elevation (70), wherein nozzles (74) are located which are directed to the loading surfaces (54) and are connected with a fluid source.

8. The apparatus of claim 7, wherein detectors (78) are located in the elevation (70) in order to determine whether a workpiece (56) is positioned on a loading surface (54).

9. The apparatus of claim 1, wherein the carrier (34) is surrounded by a side wall of a first dripping tub which extends below the carrier (34).

10. The apparatus of claim 9, wherein an additional dripping tub (82*a*) is associated with each loading surface (54) and each additional dripping tub has an outlet that drains into the first dripping tub.

11. The apparatus of claim 1, wherein the loading surfaces (54) are concave and include bores for the drainage of a liquid which is collected on the loading surface (54).

12. The apparatus of claim 1, wherein the loading surfaces (54) are provided on the top side of a separate cap-shaped element (52) which is supported on a trunnion-shaped upright support portion (50) of the carrier (34).

13. The apparatus of claim 1, wherein each loading surface further comprises at least one nozzle (64) for the cleaning of the back side of the workpiece (56) on the loading surface (54).

14. A method for the chemical-mechanical polishing of the surface of semi-conductor wafers by means of two polishing stations, each having a polishing table, two chucks for each polishing station which independently from each other can be moved vertically and horizontally, four loading surfaces, each loading surface having a center lying on a reference circle, the loading surfaces being rotatable about a vertical axis of the reference circle, the loading surfaces being located between the polishing stations such that in predetermined common rotary positions which are spaced about an angle of 90° or a multitude of 90°, two loading surfaces are aligned with the linear transport path of two chucks belonging to a polishing station, in a predetermined rotary position the loading surfaces being adapted to be loaded with a loading and unloading means with a workpiece or to remove a workpiece from the loading surfaces, comprising the following method steps:

a) after loading two loading surfaces with a first and a second workpiece, the loading surfaces are rotated about 90° about the vertical axis of the reference circle, whereby the workpieces are aligned with a first polishing station and are moved by the associated chucks to said polishing tables in order to carry out a first polishing step b) after removal of the first and second workpiece workpieces by the said associated chucks, a third workpiece and a fourth workpiece are placed on associated loading surfaces, and by rotation of the loading surfaces about 90° about the vertical axis of the reference circle, the third and fourth workpieces are aligned with the second polishing station, whereafter the first and second workpieces are removed from the first polishing station by said associated chucks and are placed on association free loading surfaces c) after rotation of the loading surfaces about 180° about the vertical axis of the reference circle, the first and the second workpieces are carried to the second polishing station and the third and fourth workpieces are carried to the first polishing station by the associated chucks d) after finishing of the polishing process the workpieces are placed on the associated loading surfaces and the third and fourth workpieces are aligned with the second polishing station and the first and second workpiece are removed by the loading and unloading means so that thereafter a loading with a fifth workpiece and sixth workpiece can take place.

15. The method of claim 14, wherein after step c) a fifth workpiece and a sixth workpiece are placed on the associated free loading surfaces and are aligned to the first polishing station after rotation about 90° about the vertical axis of the reference circle, whereafter the first and second workpieces are removed from the second polishing station and placed on the associated loading surfaces and after rotation of the loading surfaces about 90° about the vertical axis of the reference circle the first and second workpieces are removed, and by rotation about further 90° about the vertical axis of the reference circle the free loading surfaces are aligned to the first polishing station for the receipt of the third workpiece and the fourth workpiece and to the subsequent transport to the second polishing station and for the transport of the fifth and sixth workpieces to the first polishing station.

16. The method of claim 14, wherein the wafer is chemically treated, rinsed and/or cleaned.

17. An apparatus for polishing semi-conductor wafers, comprising:

a loading and unloading station for workpieces comprising:

a carrier supported for rotation about a vertical axis and driven by a rotary drive to at least three predetermined rotary positions; and first, second, third and fourth horizontal loading surfaces on the carrier;

a transfer device adapted to place workpieces on said loading surfaces and to remove the workpieces therefrom;

first and second polishing stations located adjacent to said carrier, the first polishing station having first and second polishing units, the second polishing station having third and fourth polishing units;

at least one chuck associated with each polishing unit, each chuck movable along a vertical axis and a horizontal axis to align the chuck with a loading surface, each chuck arranged to transfer a workpiece between an associated polishing unit and a loading surface; and a controller arranged to control the rotary drive of the carder and movement of the chucks.

18. The apparatus of claim 17, constructed and arranged such that when the carrier is in the first predetermined rotary position, the transfer device may place a first workpiece on the first loading surface and a second workpiece on the second loading surface; the carrier may be rotated to the second predetermined rotary position wherein the first loading surface is aligned with the first polishing unit and the second loading surface is aligned with the second polishing unit; the first workpiece may be transferred to the first polishing unit by the chuck associated with the first polishing unit, and the second workpiece may be transferred to the second polishing unit by the chuck associated with the second polishing unit; the transfer device may place a third workpiece on the fourth loading surface and a fourth workpiece on the first loading surface; the carrier may be rotated to the first predetermined rotary position wherein the second loading surface is aligned with the first polishing unit and the third loading surface is aligned with the second polishing unit; the first workpiece may be transferred to the second loading surface by the chuck associated with the first polishing unit, and the second workpiece may be transferred to the third loading surface by the chuck associated with the second polishing unit; the carrier may be rotated to the third predetermined rotary position wherein the second loading surface is aligned with the third polishing unit and the third loading surface is aligned with the fourth polishing unit; the first workpiece may be transferred to the third polishing unit by the chuck associated with the third polishing unit, and the second workpiece may be transferred to the fourth polishing unit by the chuck associated with the fourth polishing unit.

19. The apparatus of claim 18, wherein when the carrier is in the third predetermined rotary position, the fourth loading surface is aligned with the second polishing unit and the first loading surface is aligned with the second polishing unit; the third workpiece may be transferred to the first polishing unit by the chuck associated with the first polishing unit, and the fourth workpiece may be transferred to the second polishing unit by the chuck associated with the second polishing unit.

20. An apparatus for polishing semi-conductor wafers, comprising:

a loading and unloading station for workpieces comprising:

a carrier supported for rotation about a vertical axis and driven by a rotary drive to at least three predetermined rotary positions; and at least two loading surfaces on the carrier;

a transfer device adapted to place workpieces on said loading surfaces and to remove the workpieces therefrom;

first and second polishing stations located adjacent to said carrier, the first polishing station having first and second polishing units, the second polishing station having third and fourth polishing units;

a first linear guide between the first polishing station and the carrier;

a second linear guide between the second polishing station and the carrier;

at least one chuck associated with each polishing unit of the first polishing station, each chuck movable along a vertical axis, each chuck movable horizontally along the first linear guide to align the chuck with a loading surface, each chuck arranged to transfer a workpiece between an associated polishing unit and a loading surface;

at least one chuck associated with each polishing unit of the second polishing station, each chuck movable along a vertical axis, each chuck movable horizontally along the second linear guide to align the chuck with a loading surface, each chuck arranged to transfer a workpiece between an associated polishing unit and a loading surface; and a controller arranged to control the rotary drive of the carrier and movement of the chucks.

21. The apparatus of claim 20, wherein the carrier includes a centering device for each loading surface for centering a workpiece on the loading surface.

22. The apparatus of claim 21, wherein each centering device comprises a plurality of centering cams arranged about a circle, each centering cam being movable in the radial direction of the circle by an actuator.

23. The apparatus of claim 20, wherein the carrier further comprises a plurality of nozzles, each nozzle connected to a fluid source, each nozzle arranged to deliver fluid to a workpiece located on a loading surface.

24. The apparatus of claim 20, wherein the carrier further comprises a plurality of detectors, each detector arranged to detect whether a workpiece is positioned on a loading surface.

25. The apparatus of claim 20, wherein the carrier further comprises a dripping tub.

26. The apparatus of claim 20, wherein each loading surfaces is concave and includes bores for the drainage of a liquid which maybe collected on the loading surface.

* * * * *